United States Patent [19]

Naik

[11] Patent Number: 4,714,624

[45] Date of Patent: Dec. 22, 1987

[54] HIGH TEMPERATURE OXIDATION/CORROSION RESISTANT COATINGS

[75] Inventor: Subhash K. Naik, Milford, Conn.

[73] Assignee: Textron/Avco Corp., Providence, R.I.

[21] Appl. No.: 831,677

[22] Filed: Feb. 21, 1986

[51] Int. Cl.[4] ..... B05D 1/00; B05D 1/08

[52] U.S. Cl. ..... 427/34; 427/252; 427/383.9

[58] Field of Search ..... 427/34, 252, 383.9

[56] References Cited

U.S. PATENT DOCUMENTS

| | | | |
|---|---|---|---|
| 3,640,815 | 2/1972 | Schwartz | 427/252 |
| 3,824,122 | 7/1974 | Cook | 427/252 |
| 4,004,047 | 1/1977 | Grisik | 427/142 |
| 4,041,196 | 8/1977 | Baldi | 427/252 |
| 4,084,025 | 4/1978 | Rairden | 427/229 |
| 4,145,481 | 3/1979 | Gupta | 428/678 |
| 4,198,442 | 4/1980 | Gupta | 427/34 |
| 4,246,323 | 1/1981 | Bornstein | 428/678 |
| 4,325,994 | 4/1982 | Kitashima | 427/376.8 |
| 4,346,137 | 8/1982 | Hecht | 427/328 |
| 4,588,607 | 5/1986 | Matarese | 427/34 |

FOREIGN PATENT DOCUMENTS

| | | | |
|---|---|---|---|
| 2007263 | 5/1979 | United Kingdom | 427/383.9 |

*Primary Examiner*—John D. Smith
*Assistant Examiner*—Vi Duong Dang
*Attorney, Agent, or Firm*—Perman & Green

[57] ABSTRACT

Disclosed is a novel high temperature coating system comprised of two successively deposited layers of different respective materials which may be applied to turbine engine components to provide improved oxidation and corrosion resistance. The second applied layer is a composition having the general formula MCrAlY wherein M is a solid solution of molybdenum in nickel, cobalt or nickel plus cobalt. The first applied layer or interlayer, which is applied directly to the turbine engine component, is an aluminum coating.

8 Claims, No Drawings

HIGH TEMPERATURE OXIDATION/CORROSION RESISTANT COATINGS

BACKGROUND OF THE INVENTION

1. Field of the Invention

This invention relates to coating systems for the hot section components such as blades and integral/segmented nozzle vanes of gas turbine engines, and, more particularly, to coating systems which provide the coated hot section component with improved oxidation/corrosion resistance.

2. The Prior Art

Materials used for the fabrication of gas turbine components must have both exceptional elevated temperature mechanical properties and resistance to surface degradation such as oxidation and hot corrosion at elevated temperatures.

In current gas turbines, temperatures range in excess of 2500° F. and it is desired that such engines operate for prolonged periods of time without undergoing significant materials degradation.

The current high cost of quality fuels for gas turbines has made it economically attractive to use lower quality fuels or to increase the temperature of the turbine. These lower quality fuels may contain harmful alkali-sulfates which cause accelerated hot corrosion attack of the hot gas path components of gas turbines. The hot gas path components, such as vanes and blades, are generally constructed of nickel base or cobalt base superalloys. The superalloys, while possessing high strength at high temperatures, are quite prone to the accelerated corrosive effects of the hot gas path.

To prevent unacceptably rapid oxidation and corrosion rates of the hot path components, protective coatings are necessarily utilized to prolong the useful life of the components. The typical coating provides the superalloy with a surface layer characterized by increased oxidation and corrosion resistance. In the gas turbine industry, this protective layer is often formed of an aluminide which is produced by diffusion of aluminum into the surface of the hot section component to be protected, and the reaction of the aluminum with the superalloy substrate material to produce intermetallic compounds. In use, the surface of the component develops an alumina layer which acts as a barrier to prevent further oxidation of the coated component. A drawback to the use of aluminide coatings is that the coatings can be a source of fracture initiation in fatigue. Coating ductility has been found to be an important determinant in fatigue life since, at relatively low temperatures, aluminide coatings tend to crack in a brittle manner at low strains in the tensile portions of the fatigue cycle.

A second type of protective coating used for imparting oxidation/corrosion resistance to gas turbine hot section components are overlay coatings. Overlay coatings are themselves oxidation resistant and do not depend upon any reaction with of diffusion into a substrate. Typical of the overlay coatings in use today are those designated as "MCrAlY" coatings where M is nickel, cobalt, iron or mixtures thereof. A drawback to the use of MCrAlY compositions as protective coatings for gas turbine hot section components is that these coatings are conventionally applied to substrates using physical vapor deposition methods, which methods exhibit line of sight limitations. Line of sight limitation means that the material to be coated is contained within the conical angle emanating from the source (for e.g. plasma spray guns, sputter targets, etc) and coats the substrate only in the exposed areas within the conical angle spray. Such limitation results in providing incomplete coverage to integral/segmented components or complex shaped individual parts due to shadowing effects.

It is, therefore, an object of this invention to provide a metal coating composition as well as a coated article which are devoid of the above-noted disadvantages.

It is another object of this invention to produce coating compositions for use in hot, corrosive, combustion atmopsheres of the type found in gas turbines.

It is still another object of the present invention to provide coating compositions which may be applied to nickel base, cobalt base or nickel-cobalt base superalloys, and which are highly resistant to hot corrosive attack.

It is yet another object of this invention to provide high temperature metal coating compositions wherein there is increased wettability or diffusional bonding between the layers of the coating structure, resulting in reduced sites (microporosity) for thermal fatigue crack initiation and/or spallation and, hence, superior performance.

SUMMARY OF THE INVENTION

The foregoing objects, and others, are accomplished in accordance with this invention, generally speaking, by providing a high temperature metal coating system comprised of two successively deposited layers of different respective compositions which are applied to turbine engine components, the second applied layer having the general formula MCrAlY wherein M is a solid solution of molybdenum, in nickel, cobalt or nickel plus cobalt. The first applied layer of interlayer which is applied directly to the turbine engine component is an aluminide coating.

The MCrAlY overlayer coatings of the present invention exhibit diffusional compatibility with the aluminide interlayer to provide two-layer coatings exhibiting improved thermal fatique and oxidation/ corrosion resistance to the hot gases encountered in gas turbine operation.

DETAILED DESCRIPTION OF THE INVENTION

The two layer coatings of the present invention may be applied to any suitable substrate used for the fabrication of gas turbine components. Suitable substrate materials include superalloys such as nickel base and cobalt base superalloys, dispersion-strengthened alloys, composites, directionally solidified, single crystal and directional eutectics.

The MCrAlY overlay coating compositions used in the practice of the present invention contain small, but significant, amounts of molybdenum for improved wettability and diffusional compatibility of the coating with the aluminide layer. Improved wettability or bonding reduces microporosity at the precipitate ($\beta$)/matrix ($\gamma$) interface, which in turn, improves thermal fatigue resistance and oxidation and corrosion resistance of the overlay coating. This is due to a reduced tendency to form cracks at the porosity locations. There is also a reduced tendency to form voids due to diffusional (Kirkendal) effects and of spalling to occur; in general, there is better performance.

The MCrAlY coating compositions used in the practice of the present invention contain from about 30% to about 70% by weight nickel, cobalt, or nickel plus cobalt; from about 0.1% to about 18% by weight molybdenum; from about 10% to about 40% by weight chromium; from about 6% to about 20% by weight aluminum and about 0.01% to about 3.0% yttrium. Optionally small amounts, e.g. about 0.1 to about 10% by weight of a metal selected from Hf, Si, Ti, Mn, Pt and mixtures thereof may also be incorporated in the MCrAlY coating. The incorporation in the MCrAlY coating of Hf, Si, Ti, Mn and Pt, either singly or in combination, provides metals which have improved oxidation/corrosion resistance and good interdiffusion characteristics with the aluminide undercoat which therefore provides a graded coating with a good diffusional bond. A graded two-step coating reduces the thermal expansion mismatches between the successively applied coatings and improves the spallation resistance between the MCrAlY overlay and the aluminide interlayer which, in turn, relates to superior coating performance.

The MCrAlY ovarlay coating of the present invention is applied to the aluminide coated substrate at a thickness varying from about 25 μm to about 150 μm and preferably about 50 μm to about 75 μm. Among the methods by which the MCrAlY overlay coating may be applied to the aluminide coated substrate include conventional physical vapor deposition processes as for example vacuum plasma spray, sputtering and electron beam spray.

Sputtering is a coating process wherein the particles are liberated from a target surface composed of the MCrAlY alloy by bombardment of energetic ions and then accelerated towards the aluminide coated superalloy substrate under the influence of an applied high voltage in a gas at $10^{-1}$ Torr or less to deposit the required coating.

In electron beam spraying the metal coating material is heated in a vacuum chamber ($<10^{-3}$ Torr) by an electron beam focused on the material to evaporate the metal to a vapor. The electron beam heating causes metal molecules to travel from their source until they hit and deposit on the surface of the substrate to be coated.

It is preferable, herein, that the MCrAlY coating be applied to the aluminide coated substrate by means of a vacuum plasma spraying operation.

In vacuum plasma spraying, controlled amounts of the coating powder alloy are introduced in the plasma stream of the spray gun. The powder becomes molten and is projected at a very high velocity on the preheated (in the order of about 1,750° F.) surface of the part to be coated which is contained within a vacuum chamber under pressure of about $10^{-4}$ Torr or greater. Upon impact against the surface to be coated, the coating alloy particles transfer thermal and mechanical energy to the substrate, producing forces which favor fusing and bonding, thus producing a dense and adherent coating.

The plasma spraying is conducted in a low pressure chamber to develop a thickness between 25 μm–150 μm and an acceptable density of 98%. Specimens are glass bead peened at 6–7 N intensity and diffusion heat treated at 1,065° C. for about 4 hours.

The aluminide coating is deposited by a pack or gas phase process. In the pack method, the substrate to be coated is thoroughly cleaned to remove foreign debris from the substrate which is then packed in a powder whose composition comprises aluminum, chromium, and alumina in the required proportions with minor additions of activator content such as $NH_4Cl$. The pack is heated in a vacuum furnace with the pack held at about 1800 to about 2000° F. for about 1 to about 6 hours whereby a coating thickness of between about 15 μm to about 100 μm is developed on the substrate surface. The aluminide coating may also be deposited by a gas phase process wherein the parts to be coated are placed above the aforementioned pack powder on suitable racks. An inert gas (Argon) is then passed through the pack composition containing the halide activators. On heating to temperatures above about 1800° F., gaseous compounds of aluminum (e.g. $AlCl_3$) are carried through the inert gas and react with the nickel-based superalloy substrate to deposit the aluminide coating. The aluminide coating, typically contains about 22 to about 40 weight % aluminum, the balance being nickel.

Typical processing sequences to coat hot section turbine engine parts for improved oxidation and corrosion resistance are as follows: For components which have no line-of-sight limitation (e.g, individual blades and vanes with simple airfoil shapes); the part is first aluminide-coated over the entire airfoil surface (including the internal cooling passages) and then overcoated with the said MCrAlY type composition. The coated part then undergoes a diffusional heat treatment at about 1975° F. for about 4 hours in an argon or vacuum ($10^{-3}$ Torr) atmosphere.

For components which have a line-of-sight limitation (e.g., integral or segmented nozzle parts or individual blades with complex or twisted airfoil surfaces), the part is first aluminide-coated over the entire airfoil surface (including the internal passages), and then subsequently coated with the said MCrAlY type composition at the critical regions (e.g., leading and trailing edges) which require superior oxidation and corrosion resistance for improved durability. The above-mentioned coated part then undergoes a diffusional heat treatment at about 1975° F. for about 4 hours in an argon or vacuum (about $10^{-3}$ Torr) atmosphere.

The present invention may be better understood through reference to the following example which is meant to be illustrative rather than limiting.

EXAMPLE

A nickel base superalloy substrate was first coated with a 50–100 μm coating of an aluminide using a pack or gas phase process wherein the substrate was coated with a pack powder containing aluminum, chromium, alumina and the required activator in a vacuum furnace at 1900° F. for 4 hours. Thereafter, a 80 μm thick MCrAlY coating composed of 3% by weight Mo, 54.4% by weight Ni, 12% by weight Co, 18% by weight Cr, 12% by weight Al and 0.6% by weight Y was deposited on the aluminide coated substrate by vacuum plasma spray.

The procedure of the Example was repeated with the exception that about 3% by weight of Hf, and Si, was incorporated in the MCrAlY composition.

Test specimens having these coating systems applied thereto were tested for oxidation/corrosion resistance using a fuel (JP-5) fired rig facility. The rig was a self-contained facility with its own air compressor, air preheater, test chamber and fuel system. High velocity gases of approximately 215 m/s were impinged against the test specimens to raise them to the desired temperature. A converging nozzle was used to direct and concentrate the flame on the specimens. Synthetic sea water was injected into the gas stream just below the skirt of the combination liner. The combuster burned JP-5+0.2% S fuel for this test. The pressure in the test chamber was essentially atmospheric. The air to fuel ratio ranged from about 28:1–33:1 depending on the test temperature. Air flow was maintained constant at 0.378 kg/sec. at 285° C. while the fuel was controlled by means of a pyrometer which sensed the metal temperatures. The specimen was rotated in order to expose all specimens uniformly. Heating and cooling cycles were accomplished by alternately translating the specimen holder between the furnace heating and cooling chambers. Thermal cooling was imposed by a water mist spray.

The oxidation/corrosion tests undertaken were conducted on the coating of the Example. A two temperature-set point, 6.75 minute cycle (1,650° F./2 minutes and 1,950° F./2 minutes and water cool) was used for testing. The salt/air ratio was maintained at 6 ppm and 0.2% sulfur was added to the JP-5 fuel. For purposes of comparison, test specimens coated only with MCrAlY or Aluminide or uncoated were also evaluated for oxidation/corrosion resistance. The test specimens were placed in the specimen holder and the test specimens were weighted and visually inspected at 20 hour intervals. The comparative weight loss of various coatings at the end of various test cycles of a cyclic oxidation/corrosion test is listed in the table below:

TABLE

| Coating System | % - weight loss | Cycles at Test |
|---|---|---|
| 1. Aluminide + NiMoCoCrAlY | −0.095 | 1170 |
| 2. Aluminide + (NiMoCoCrAlY + Hf, Si) | −0.097 | 1800 |
| 3. NiMoCoCrAlY | −0.163 | 1260 |
| 4. Aluminide | −0.163 | 1170 |
| 5. Uncoated | −0.163 | 700 |

It is evident from the Table, above, that duplex (Aluminide+NiMoCoCrAlY, Aluminide+NiMoCoCrAlY+Hf, Si) coatings of the composition specified exhibit superior performance in oxidation/corrosion resistance based on weight loss over either the individual aluminide or the NiMoCoCrAlY coating.

While specific components of the present system are defined above, many other variables may be introduced which may in any way affect, enhance or otherwise improve the coating systems of the present invention.

While variations are given in the present application, many modifications and ramifications will occur to those skilled in the art upon reading the present disclosure, These are intended to be included herein.

I claim:

1. A process for manufacturing an individual engine component having a simplified airfoil shape which comprises first aluminide-coating said component; then overcoating same with a MCrAlY composition wherein M is a solid solution of molybdenum and a second metal selected from the group consisting of nickel, cobalt and mixtures thereof, the composition being comprised of from about 0.1 to about 18% by weight of molybdenum, about 30 to about 70% by weight of the second metal, about 10 to about 40% by weight of chromium about 6 to about 20% by weight of aluminum and about 0.01 to about 3% by weight of yttrium; and then subjecting said component to diffusional heat treatment.

2. The process of claim 1 wherein said engine component comprises a single blade or single vane.

3. A process for manufacturing either an individual engine component with complex airfoils or an integral segmented component which comprises first aluminide-coating said component over the airfoil surfaces; then overcoating same with a MCrAlY composition at selected regions of the airfoil requiring superior oxidation and corrosion resistance wherein M is a solid solution of molybdenum and a second metal selected from the group consisting of nickel, cobalt and mixtures thereof, the composition being comprised of from about 0.1 to about 18% by weight of molybdenum, about 30 to about 70% by weight of the second metal, about 10 to about 40% by weight of chromium, about 6 to about 20% by weight of aluminum and about 0.01 to about 3% by weight of yttrium; and then subjecting the component to diffusional heat treatment.

4. The process of claims 1, 2 or 3 wherein said diffusional heat treatment takes place at about 1975° F. for about 4 hours in either an argon atmosphere or in a vacuum under a pressure of about $10^{-3}$ Torr.

5. The process of claim 4 wherein the MCrAlY coating layer further contains about 0.1 to about 10% by weight of a metal selected from the group consisting of Hf, Si, Ti, Mn and Pt.

6. The process of claim 4 wherein the aluminide coating deposit has a composition which contains about 22 to about 40% by weight aluminum, the balance being nickel.

7. The process of claim 4 wherein the aluminide coating is about 25 to about 75 μm thick and the MCrAlY composition is about 25 to about 150μm thick.

8. The process of claim 4 wherein the component is comprised of a nickel-base or a cobalt-base super-alloy.

* * * * *